US009457880B2

(12) United States Patent
Henriksen

(10) Patent No.: US 9,457,880 B2
(45) Date of Patent: Oct. 4, 2016

(54) PROPULSOR ARRANGEMENT FOR A MARINE VESSEL AND A MARINE VESSEL CONSTRUCTED WITH THIS TYPE OF PROPULSOR ARRANGEMENT

(71) Applicant: ROLLS ROYCE AB, Kristinehamn (SE)

(72) Inventor: Thomas Henriksen, Kristinehamn (SE)

(73) Assignee: Rolls-Royce AB (SE)

( * ) Notice: Subject to any disclaimer, the term of this patent is extended or adjusted under 35 U.S.C. 154(b) by 0 days.

(21) Appl. No.: 14/376,633

(22) PCT Filed: Feb. 7, 2013

(86) PCT No.: PCT/SE2013/050102
§ 371 (c)(1),
(2) Date: Aug. 5, 2014

(87) PCT Pub. No.: WO2013/119175
PCT Pub. Date: Aug. 15, 2013

(65) Prior Publication Data

US 2015/0047543 A1 Feb. 19, 2015

(30) Foreign Application Priority Data

Feb. 7, 2012 (SE) ..... 1250089

(51) Int. Cl.
*B63H 5/125* (2006.01)
*B63B 35/08* (2006.01)
*B63H 25/42* (2006.01)

(52) U.S. Cl.
CPC ..... *B63H 5/125* (2013.01); *B63B 35/08* (2013.01); *B63H 25/42* (2013.01); *B63H 2005/1254* (2013.01)

(58) Field of Classification Search
CPC ..... B63H 5/00; B63H 5/08; B63H 25/46; B63H 25/42; B63H 5/125; B63B 35/08; B63B 35/00; B63B 35/68; G05D 1/02; G05D 1/0208
USPC ..... 114/144 B, 151, 42
See application file for complete search history.

(56) References Cited

U.S. PATENT DOCUMENTS 3,548,775 A * 12/1970 Horn ..... G05D 1/0208 114/144 B
6,079,346 A 6/2000 Kooren
6,439,936 B1 * 8/2002 Dreith ..... B63B 17/0018 114/144 B
2010/0162934 A1 7/2010 Suojanen et al.

FOREIGN PATENT DOCUMENTS

KR 20110113528 A 10/2011
WO 99/14113 A1 3/1999
WO 2012/008901 A1 1/2012

OTHER PUBLICATIONS

International Search Report dated May 13, 2013 corresponding to International Patent Application No. PCT/SE2013/050102, 5 pages.

* cited by examiner

*Primary Examiner* — Lars A Olson
(74) *Attorney, Agent, or Firm* — Eric L. Sophir; Dentons US LLP

(57) ABSTRACT

A propulsor arrangement for operation in icy as well as open water, for a marine vessel having a hull (S) with a center line (CL) extending between a forward end (3) and an aft end (4), said propulsor arrangement comprising a plurality of azimuthing thrusters (1A-ID) having a center of rotation (CR) and a longest lateral distance (R) that it protrudes from said center of rotation (CR), preferably having at least one azimuthing thruster (1A-ID) with a propeller (2) arranged to act in ice, wherein said propulsor arrangement includes at least three azimuthing thrusters (1A, 1B, 1G) positioned close to one end (3, 4) of said hull (S), including at least one pair (1A, 1B) positioned substantially symmetrical in relation to said center line (CL) along a transversal line in relation to said center line (CL) a first distance (Q1) apart a and at least one azimuthing thruster (1G) positioned closer to said end (3, 4) and said centerline (CL) and positioned a longitudinal distance (P1) away from said transversal line.

28 Claims, 4 Drawing Sheets

PROPULSOR ARRANGEMENT FOR A MARINE VESSEL AND A MARINE VESSEL CONSTRUCTED WITH THIS TYPE OF PROPULSOR ARRANGEMENT

This application claims priority to PCT/SE2013/050102, filed Feb. 7, 2013, entitled "A PROPULSOR ARRANGEMENT FOR A MARINE VESSEL AND A MARINE VESSEL CONSTRUCTED WITH THIS TYPE OF PROPULSOR ARRANGEMENT," which claims priority to Swedish Patent Application No. 1250089-8, filed Feb. 7, 2012, all of which are incorporated by reference in their entirety.

FIELD OF THE INVENTION

The present invention relates to a propulsor arrangement, to steer and propel a marine vessel in forward or aftward direction that is intended to operate in open as well as icy waters, for instance an icebreaker or a tanker, a cargo or a container vessel or similar transport vessel, comprising a plurality of azimuthing propulsors. The invention also relates to a marine vessel intended to operate in open as well as icy waters having such a propulsor arrangement.

BACKGROUND OF THE INVENTION

Some marine vessels use a kind of propulsor that has a steering arrangement such that the propeller and its thrust can be directed in different directions. Such azimuthing propulsors can therefore be used for both steering and propulsion and therefore eliminates the need of rudders and stern tunnel thrusters, in addition such azimuthing propulsors have proven to be efficient in connection with icebreaking. The azimuthing propulsors comprises a casing with a strut and is arranged as a separate unit outside the hull and with the strut connected to a steering mechanism inside the hull. At one or both ends of the casing, a propeller is attached. The motor for driving the propeller may be located inside the casing or inside the vessels hull. When the motor is located inside the casing, the motor is usually an electrical motor and such an azimuthing propulsor with an electrical motor inside the casing is usually called an azimuthing electric Pod drive. When the motor is placed inside the hull, the motor is often a diesel engine or an electric inboard motor with the power transmitted to the propeller through a mechanical transmission including one or several gears. Such a propulsor is usually called an azimuthing mechanical thruster. The azimuthing propulsors can be of both pushing and pulling types, meaning that the propeller can be located upstream or downstream of the casing, and have one or two propellers rotating in the same direction, or contra-rotating, and be equipped with or without nozzles. The propeller can also be replaced by a pump jet rotor.

From the field of technology it is known that there are vessel designs proposed with azimuthing propulsors in different applications where the characteristics of the azimuthing propulsor are important for the desired characteristics of the vessel. The prior art solutions include configurations with one or two azimuthing propulsors located near to one end of the ship, usually the aft part. In twin propulsor configuration the propulsors are usually located symmetrically to the longitudinal axis of the vessel. In triple propulsor configuration the third propulsor is usually located at some distance in forward direction from the two aft propulsors and on the longitudinal axis of the vessel. The disadvantage of these configurations is that the available power is limited due to the limitation in size of azimuthing propulsors.

The ability to operate large vessels safely in narrow channels or shallow waters, and especially in icy waters with drifting ice, depends largely on the maneuverability. One advantage of the azimuthing propulsor is that it can be turned so that the thrust force can be directed into any direction allowing the use of full propulsion power for steering, giving maximum maneuvering capability. By turning the azimuthing propulsors to give thrust in the opposite direction of the movement of the vessel, the vessel can quickly be brought to standstill, an important property for safe operation and especially when vessels are operated in convoy after an escorting icebreaker. The properties of the azimuthing propulsor has also been found useful in connection with icebreaking and specifically in connection with Double-Acting Ships (DAS) according to the concept described in U.S. Pat. No. 5,218,917, where the vessel is designed to go astern in heavy ice with a stern shaped for icebreaking and making use of the azimuthing propulsors to mill a channel through ice ridges. The possible size of a vessel including a DAS depends largely on the available thrust at low speed which is known as Bollard pull and the thrust required propelling the vessel at its maximum speed in open water. Therefore important characteristics as performance in ice as well as speed and size of the vessel, are dependent on the available size of azimuthing propulsors. The size of the azimuthing propulsor is limited by the possibility to fit it under the hull due to its physical size and weight. There are also design limitations that limits the availability of large ice strengthened azimuthing propulsors. The requirements defined by classification societies for vessels operating in ice will also put limitations on the available sizes.

To solve the problem of limited power from azimuthing propulsors, a hybrid solution has been proposed as described in patent publication US 2005/0070179 A1, where two wing mounted azimuthing propulsors have been combined with a conventional shaft line propeller in the centre. This solution has significant disadvantages in that the power available for steering is significantly reduced, as the centre propeller which is designed to take a large part of the power is fixed and can only deliver thrust in astern direction to push the vessel ahead and to a limited extent in the opposite direction when it is reversed. The available power and thrust for operation astern is therefore also reduced.

Furthermore, the centre propeller tends to be large in diameter when high thrust is needed, thus increasing the draft of the vessel and the required ballast draft and thereby increasing fuel consumption during the ballast voyage. US20050070179 in a speculative manner mention that a POD may be used in place of the center propeller, however such an arrangement does also present disadvantages due to the positioning of the POD in the center.

A similar solution has also been proposed, in patent publication US 2010/0162934 A1, to solve the problem with limitation in power and Bollard pull in connection with icebreaking and DAS. The disadvantage of less maneuvering capability becomes more significant when operating in ice, and the turning radius for a long vessel could become larger than what is acceptable, thus reducing the possible size of the vessel. The big centre propeller will usually be installed near the aft end to get a reasonable draft of the vessel; it will then come so close to the azimuthing propulsors that it will block the usage of them in large angular sectors. A big propeller in the centre will also move the two azimuthing propulsors apart a distance, to avoid the slipstream from the centre propeller when moving ahead in forward direction, thus increasing the risk that big ice blocks can accumulate and get stuck in the centre when moving ahead in aftward direction during icebreaking.

Moreover from U.S. Pat. No. 6,439,936B1 there is known a drill ship which uses a plurality of propulsor units, which arrangement seen from a ice breaking perspective presents disadvantages from several aspect, e.g. by using several centrally positioned POD units.

DISCLOSURE OF THE INVENTION

It is the object of the present invention to provide an azimuthing propulsor arrangement to enable larger vessels to be used, or vessels with high power and thrust demand, or with high requirement on maneuverability and redundancy to fulfill their operational tasks in a safe and reliable way. A propulsor arrangement which is suitable for icebreaking (ice-crushing, ice-milling) as well as for operation in a broken channel and in open water and which optimizes both the icebreaking capability and the maneuvering capability for a vessel operating in ice as well as the performances in open water, which is achieved by means of an arrangement as defined in the appended claims.

With this invention the power can be increased so that larger vessels can be used without increasing the physical size of the propulsors, which would otherwise require an increased draft of the vessel. This invention will also increase redundancy and operational flexibility which will improve performance and safety of the vessel in various modes of operation.

The invention also relates to the operation of the azimuthing propulsors to optimize the capabilities of a vessel operating in ice.

In a preferred embodiment of the invention, the propulsors are fitted to one end of the vessel. This is preferably in the aft of the vessel, but could also be in the bow of the vessel. It could also be that propulsors, on the same vessel, are fitted in both ends of it.

According to one preferable design aspect for an arrangement according to the invention, using multiple propulsors, situations may be avoided when the slipstream from one propulsor hits another one, without reducing the main operational performances of the vessel.

According to another preferable aspect of the invention, when operating the vessel ahead at higher speeds preferably the aftmost propulsors are used for steering. Further the propulsors located at forward longitudinal positions may preferably be limited in steering angles so as to avoid that their slipstream hit propulsors located further aftward.

Preferably four azimuthing propulsors are used, but could also be more or less, for example 3, or 5 to 7. One benefit of using multiple propulsors instead of a few is that the same total propeller disc area can be achieved by using a smaller propeller diameter. This is beneficial in ice operation in that the distance between the tip of the propeller and the hull, i.e. the propeller tip clearance can be kept bigger, assuming a specified draft of the vessel. This is beneficial in that it allows for less interaction with level ice and thus less stress to the propellers. This could alternatively be used in that the strut of the propulsor can be kept shorter to achieve less stress to the unit structure, by having less leverage of the ice loads acting on the propeller and structure. This also facilitate design of vessels for shallow draft and can keep the ballast draft low also for bigger vessels, thus reducing fuel consumption during the ballast voyage, without cargo.

This invention gives significant advantages to the design of vessels that is intended to operate in open as well as icy waters, for instance an icebreaker or a tanker, a cargo or a container vessel or similar transport vessel. It is possible to use larger vessels, which is important for the economy of most transportation project, without giving up requirement on maneuvering and icebreaking capability in shallow waters. In fact this invention will, as described in the following detailed description and in the claims, give an increased operational flexibility of the vessels which can be used to improve the icebreaking performance for the DAS concept. The invention will also increase the redundancy for propulsion and steering of the vessel, thus increasing significantly the safety of operation.

BRIEF DESCRIPTION OF THE DRAWINGS

In the following the invention will be described in more detail with reference to the appended figures wherein.

DETAILED DESCRIPTION OF THE INVENTION

In FIGS. 1-14 there is schematically shown the aft end 4 of a vessel having a hull 5, using a plurality of azimuthing propulsors 1A-1G, wherein in accordance with a preferred embodiment of the invention the design includes a V-shaped multiple arrangement of smaller azimuthing propulsors (instead of a few larger ones), e.g. up to 7 azimuthing propulsors 1A-1G, on the vessel S.

In the detailed description, and schematic drawings there is shown and described pulling type of azimuthing propulsors 1A-1G with an open propeller 2 at one end of the propulsor casing, arranged in a symmetrical way around the longitudinal axis CL of the hull S, at the aft end 4. The principal arrangement can also be used for pushing propulsors or dual propeller propulsors with propellers that could be rotating in the same direction or contra-rotating. The same arrangement can also be mirrored to the other end of the vessel. The arrangement need not to be symmetrical but propulsor positions can be adjusted individually.

Figure 1:
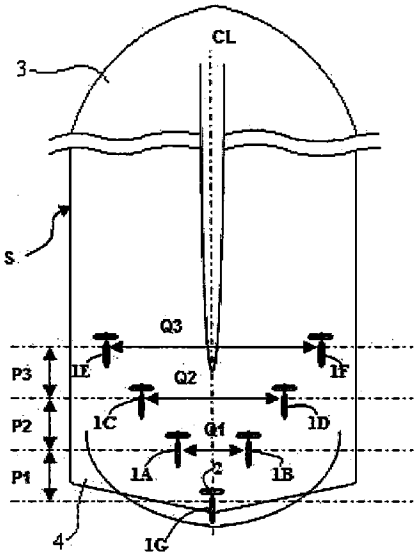
FIG. 1 shows schematically, the aft of a vessel having a symmetrical septuple azimuthing propulsor arrangement according to the invention with all propulsors oriented for operation ahead.

According to one aspect with an arrangement of the invention, the multiple propulsors are positioned to avoid situations when the slipstream from one propulsor hits another one. This objective can be reached with a V-shaped arrangement as shown in FIG. 1, for a septuple configuration. In the case with an odd number of propulsors the first one 1G is located in the center near to the aft end 4 of the vessel. The two next propulsors 1A, 1B are located at some longitudinal distance P1 in forward direction of the first one and at lateral distances Q1, preferably symmetrical but could also be asymmetrical, from the longitudinal axis CL of the vessel, so as to avoid that their slipstream will hit the first propulsor while operating at high speed in forward direction and to allow enough clearance to be able to turn the propulsors around without touching each other. Next pair of propulsors 1C, 1D is located at some longitudinal distance P2 in forward direction of the first pair 1A, 1B and at increased lateral positions Q2, so as to avoid that their slipstream will hit the first pair of propulsors 1A, 1B while operating at high speed in forward direction. Next two propulsor 1E, 1F are located at another longitudinal distance P3 in forward direction and at lateral positions Q3 further out towards the sideboard of the vessel.

Figure 2:
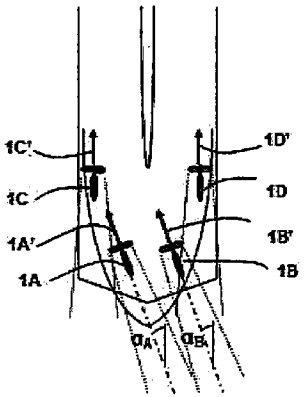
FIG. 2 shows schematically, a further embodiment according to the invention, having four propulsors how the propulsors can be oriented for turning while maintaining thrust for operation ahead.

As shown in FIG. 2, an arrangement of four thrusters (or pods) are used, each one enabling providing a thrust vector 1A'-1D'. With an even number of azimuthing propulsors the first single unit (1G in FIG. 1) is removed and the first pair of propulsors are moved closer to the aft end of the vessel and preferably moved closer together. One benefit of using 4 thrusters instead of 3 is that the same total propeller disc area TA can be achieved by using a smaller propeller diameter D. This is beneficial in ice operation in that the distance X (see FIG. 15) between the tip of the propeller 2 and the hull, i.e. the propeller tip clearance X, can be kept bigger, assuming a specified draft of the vessel. This is beneficial in that it allows for less interaction with level ice and thus less stress to the propellers. Furthermore the novel concept allows for a surprising flexibility regarding operation and function of the propulsion arrangement as will be exemplified below. This also allows for a lower ballast draft of the vessel, in non-icy waters, which could be beneficial when operating without cargo.

Another way of utilizing the higher number of propulsors is, that instead of using smaller diameter propellers, having the same diameter as for the triplet solution. By this a higher total efficiency can be achieved in distributing the propulsive thrust on a bigger total disc area, Moreover the concept may also be used in that the strut of the thruster can be kept shorter to achieve less stress to the unit structure by having less lever of the ice loads acting on the propeller and structure.

FIG. 1 shows pulling type of propulsors which pull the vessel ahead. However, also propulsors of pushing type, may be used, that push the vessel ahead or a combination of both types. In FIG. 1 the propulsors are arranged from the aft end 4 and forward on the vessel. They could also be arranged from the forward end (not shown) and aftward on the vessel. Even if in FIG. 1 it is shown propulsors where each lateral pair is arranged at the same longitudinal position and symmetrical to the longitudinal axis CL, it is within the concept that they can all in specific applications be adjusted in their relative positions.

In FIG. 1 a septuple configuration with 7 propulsors is shown. The objective is achieved with a V-shaped arrangement such that the first propulsor, 1G, is located in the center, on the longitudinal axis of the vessel, preferably as close as possible to the aft end of the vessel with a minimum distance of 1R, equal to the maximum turning radius of the propulsor (see FIG. 15), from the aft borderline so that the entire propulsor stays within the borderline when turning around 360°, but could also be up to 2R or more, like for instance on a vessel with the aft section designed for icebreaking (DAS).

For certain applications though, the distance could be less than 1R as well.

The rest of the propulsors 1A-1F are arranged in lateral pairs at 3 longitudinal positions P1-P3, or 2 P1-P2 for a pentuple configuration with 5 propulsors, and 1 P1 for a triple configuration with 3 propulsors. The first lateral pair, 1A and 1B, is located at some distance P1 in forward direction of the first propulsor, preferably at a distance of 2-3R but it could also be more or less. The lateral distance Q1 between them should preferably be kept as short as possible to allow for lateral space to locate next row of propulsors but long enough avoiding the slipstreams to hit the first propulsor. Minimum distance is 1R to have enough clearance to be able to turn the propulsors around 360°, without touching each other, but could also be up to 4R or more. Second lateral pair of propulsors, 1C and 1D, are located at some distance P2 in forward direction of the first pair, preferably at a distance of 2-3R but it could also be more or less. The lateral distance Q2 is increased compared to the first pair so as to avoid that their slipstream will hit the first pair of propulsors, preferably it is increased 2-4D, where D corresponds to the diameter of the propeller (see FIG. 15), but it could also be more or less. The third pair of propulsors, 1E and 1F is located at another longitudinal distance P3 in forward direction of the second pair preferably at a distance of 2-3R but it could also be more or less. The lateral distance Q3 is increased compared to the second pair so as to avoid that their slipstream will hit the second pair of propulsors, preferably it is increased 2-4D, but it could also be more or less, however preferably not closer than 1R to the sideboard of the vessel.

Should an even number of azimuthing propulsors be desired, the first unit 1G, at the bottom of the V, is removed and the lateral pairs of propulsors, 2 pairs for a quadruple configuration and 3 pairs for a hextuple configuration, are adjusted in their positions so that the first pair is located nearer to the aft part of the vessel and their lateral distance is preferably reduced to minimum 1R, but could also be more. The other pairs are adjusted correspondingly according to the scheme detailed above.

When operating the vessel ahead at higher speeds preferably the aftmost propulsors are used for steering. The propulsors located at forward longitudinal positions may preferably be limited in steering angles so as to avoid that their slipstream hit propulsors located in aftward direction.

One benefit of using multiple propulsors instead of a few is that the same total thrust can be achieved by using smaller propeller diameters D as already mentioned. This is beneficial in ice operation in that the clearance between the tip of the propeller 2 and the hull S, can be made larger. In addition ice blocks that may hit the propeller will create smaller shock loads to the azimuthing system, if the propulsor units are kept small as well. Further, for vessels designed for shallow draft, the minimum draft, T, is limited by the size of the propeller and the required clearance between the propeller and the hull (D+X). Smaller propellers will therefore facilitate design of vessels with shallow draft, which for instance are needed in parts of the Arctic Ocean and for operation in rivers or river mouths.

Moreover the so called ballast draft, defined as the draft when the vessel is operating without cargo, often depend on the required deep going to avoid propeller ventilation. With a smaller propeller the vessel can be designed for a lower ballast draft which would save fuel during the ballast voyage in open water.

Turning capability in icy waters is important for the safe operation of a vessel and depends to a large extent on the length to breadth relationship L/B, for the vessel. A long vessel is therefore more difficult to turn than a short vessel. In fact this relationship will limit the possible length of a vessel operating in ice. This invention makes it possible to use all the available thrust force for steering as it use only azimuthing propulsors which have the ability to apply the thrust force in any direction, $\alpha_A$-$\alpha_G$. Together with the increased operational flexibility of having more propulsors, the turning capability can be improved and allow for usage of larger vessels.

Figure 3:
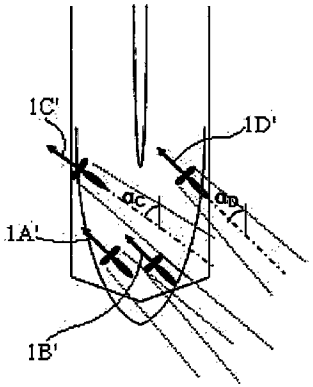
FIG. 3 shows schematically, how the propulsors can be oriented to give more turning thrust while still maintaining thrust for operation ahead.
Figure 4:
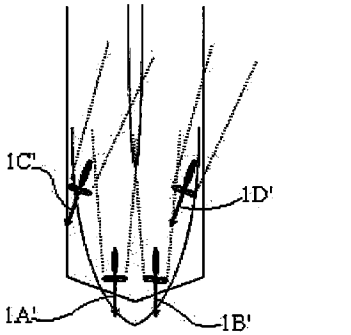
FIG. 4 shows schematically, how the propulsors can be oriented for turning while maintaining thrust for operation astern.
Figure 5:
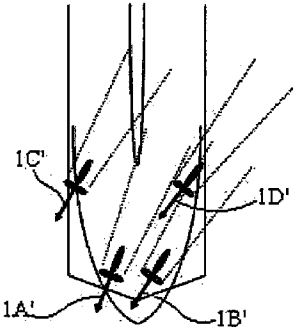
FIG. 5 shows schematically, how the propulsors can be oriented to give more turning thrust while still maintaining thrust for operation astern.

In FIG. 2 it is shown a way to apply steering forces, while maintaining significant propulsive thrust in forward direction for a quadruple configuration of pulling Pod drives. The two aftmost Pod drives, 1A and 1B, are set out to angles $\alpha_A$ and $\alpha_B$ to give side thrust as well as forward thrust. The angles could be from ±0-90 to get different level of turning force. In FIG. 3 it is shown a way to get even more side thrust by setting out all four Pod drives, 1A-1D, to angles $\alpha_A$-$\alpha_D$=±0-90°. Maximum side force is achieved when all propulsors, 1A-1D, are set out to 90° angles or near to that, see FIGS. 13 and 14. The propulsive thrust ahead is then insignificant or zero and the full thrust force can be used to turn the vessel on the spot. In FIGS. 4 and 5 it is shown similar ways to turn but with a DAS while going astern.

This invention increases redundancy in steering and propulsion of the vessel and therefore the safety and reliability of the vessel. By using azimuthing propulsors a crash stop can be performed by turning all the propulsors 180° and use the full propulsive power to stop the vessel. This is particularly important for vessels operating in arctic waters and especially for vessels operating in convoy after an escorting icebreaker.

The increased number of propulsors will generally increase the total rudder area compared with a configuration with only a few propulsors. This increases the vessels course stability and reduce steering during operation in open water, which in turn will improve fuel economy and reduce maintenance cost.

Smaller propulsors are easier to handle due to lower weight and size which simplifies installation and maintenance of them. Smaller units are also easier to design to classification society's requirements for operation in heavy ice as the ice loads are smaller.

The novel arrangement, of multiple propulsor configurations, gives additional operational flexibility that can be used to improve icebreaking, especially in connection with DAS. In the following some different cases are described with a quadruple configuration of pulling Pod drives.

Figure 15:
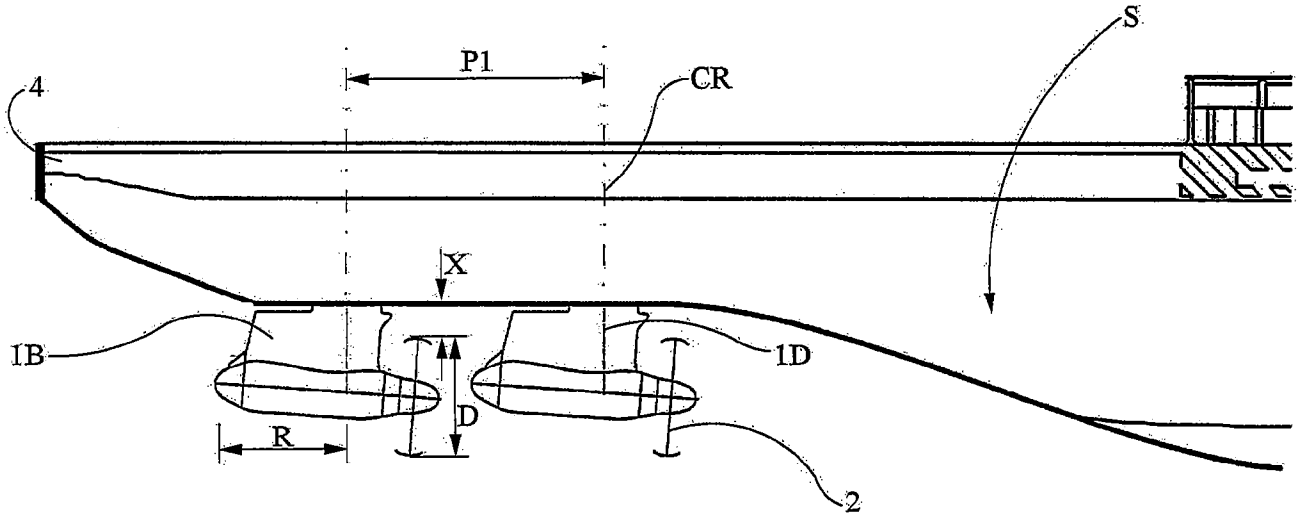
FIG. 15 is a schematic representation of a marine vessel with four azimuthing propulsors arranged according to the invention in that end K which is known as the aft end 4 of the vessel and oriented for operation ahead.
Figure 16:
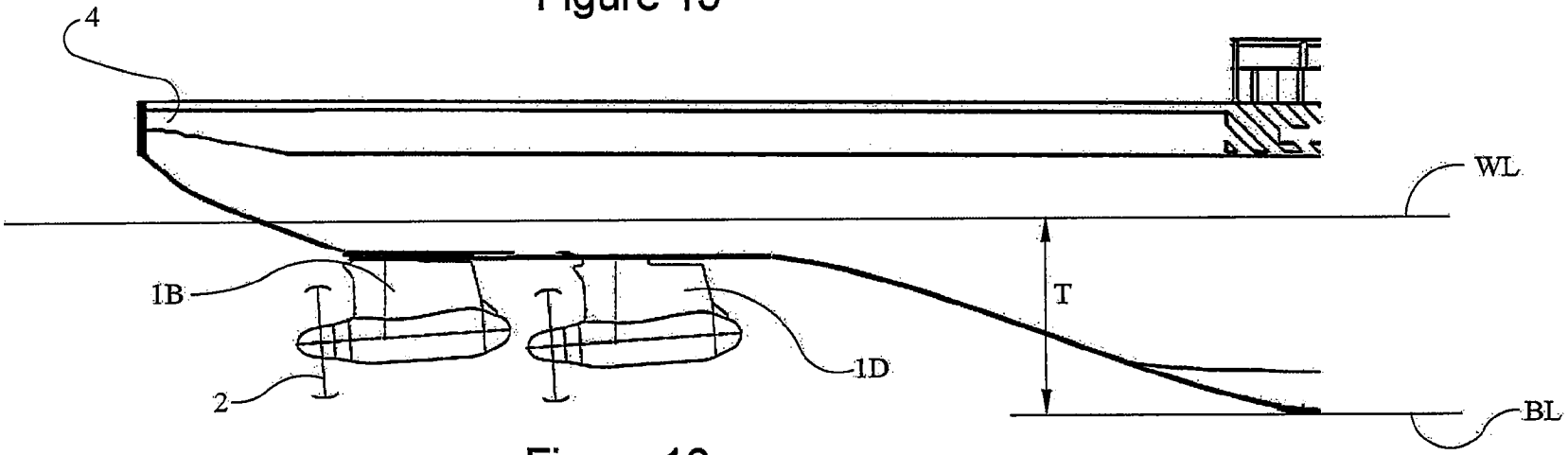
FIG. 16 shows, schematically, the same marine vessel but with the propulsors oriented for operation astern.

As shown in FIGS. 15 and 16 the Pod drives, 1A-1D, may preferably be mounted in the aft section 4 of the vessel, having a propeller 2 which is rotatable about a propeller axis in a plane of rotation for the propeller. The propeller 2 is mounted on a shaft (as known per se, not shown) that is rotatable together with the propeller 2. The propeller is mounted on one side of the Pod drive and is pulling the Pod drive ahead when rotated in its design direction and is pushing the Pod drive in the other direction when reversed. In FIG. 15 the Pod drives are oriented such that the vessel is moving ahead in forward direction of the vessel and the water flow from the propeller is in aftward direction of the vessel.

In FIG. 16 the Pod drives are oriented such that the vessel is moving astern and the water flow from the propeller is in the forward direction of the vessel. The propeller is designed such that the propeller, when operating in icy waters, can interact with ice. The Pod drives, 1A-1D, can be rotated in relation to the hull of the marine vessel S such that the arrangement can propel the marine vessel S in different directions. The Pod drives 1A-1D can be controlled separately regarding both steering direction and propulsion thrust produced. The control of the units may be arranged so that an optimal transportation and icebreaking can be achieved.

The propeller 2 may in many applications have a diameter which is in the range of, for example, preferably within 0.5 m-8 m, more preferred in the range of 1 m-6 m. The diameter could also be larger than 8 m. In some cases, propellers used for icebreaking (ice-crushing, ice-milling) could conceivably even have a diameter up to 10 m or more and propulsion units according to the invention could conceivably have such large propellers. Thanks to using more than three thruster units 1A-1D the propeller diameter D may be kept relatively small to achieve the desired total draft TA, e.g. enabling the distance X between the tip of the propeller 2 and the hull, i.e. the propeller tip clearance X, to be relatively large, e.g. larger than 0.3 D, preferably larger than 0.4 D or sometimes even more preferred 0.5 D or larger, or instead to enable any of the other advantages/possibilities mentioned above.

The propulsion units 1A-1D may be an azimuthing thruster with an internal electrical motor (as known per se, not shown) or it may be an azimuthing thruster driven through a transmission by a diesel engine inside the hull or by a diesel-electric motor (as known per se, not shown). The transmission may be an L-drive or a Z-drive (as known per se, not shown).

The blades of the propeller 2 may have a variable pitch. The propulsion unit 1 may also be designed for variable speed of the propeller 3. The propellers can also be equipped with an ice breaking hub, as described in patent application 1051155-8 to further improve the ice breaking capability when meeting e.g. ice ridges.

Example 1

When operating in heavy ice with a single or twin propulsor arrangement, especially during ice milling with a DAS, there is a risk that the propellers get stuck in the ice. To break loose from such a situation it is required that the propulsors are heavily over-dimensioned with regard to available shaft torque and/or azimuthing torque. In a multiple propulsor arrangement the risk that all propulsors should get stuck at the same time is negligible, so in case the aftmost propulsor(s) get stuck the others can be used to pull the vessel in direction from the ice so as to release the aftmost propulsors from the ice.

Figure 6:
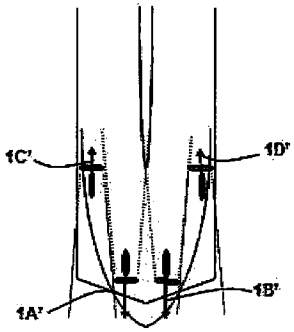
FIG. 6 shows schematically, a way to orient the propulsors for operation astern whilst breaking ice and controlling the speed of the vessel.

When using the aftmost propulsors to penetrate a ridge it is possible to balance the astern thrust with the forward propulsors to reduce the risk for the propellers to get stuck and to optimize the penetration speed. In FIG. 6 is shown a situation where the aftmost propulsors are used to penetrate an ice formation while the foremost propulsors are used to control the speed of the vessel through the ice formation without having to slow down the ice penetrating propulsors. Propulsors, 1C and 1D generate thrust 1C' and 1D' which is used to slow down the vessel so that the speed into the ice formation is optimized.

Example 2

It is known that certain types of gas engines, used to motor generators to produce electricity onboard a vessel, are sensitive to load fluctuations, such that if the propeller looses its rpm, while penetrating an ice formation, the power consumption will be reduced very quickly and there is a risk that it could create a blackout onboard. With a multiple configuration of propulsors the load fluctuation, when a propulsor looses its rpm will be smaller as the power on each propulsor is smaller. However it can be further reduced if operating as in FIG. 6. If the rpm on the forward Pod drives is increased when the rpm on the aftmost is reduced, the power fluctuation on the system will also be reduced. This way of controlling the propulsors will have the dual effect of releasing the aftmost propulsors so that they can more quickly restore their rpm.

It is evident that for the skilled person that the specific method described in the two paragraphs above is not limited to use in connection with azimuting thrusters, but can also be used in connection with hybrid propulsion arrangements having one or more fixed propulsors. It is foreseen that an individual protection may be desired, e.g. by the filing of a divisional application, wherein the claims also include fixed propulsors.

Example 3

Figure 7:
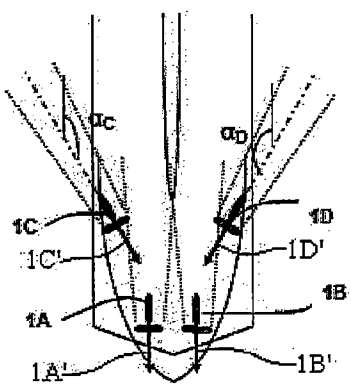
FIG. 7 shows schematically, how the foremost propulsors can be oriented so that its water wash is directed outwards to help transport the broken ice away from the hull and in under the remaining ice, thus reducing the friction of the hull and cleaning the channel whilst also, with the water wash, widen the channel.

In FIG. 7 the foremost Pod drives, 1C and 1D, have been turned inwards with angles $\alpha_c$ and $\alpha_D$, to transport the ice milled by the aftmost Pod drives 1A and 1B, away from the vessels hull and reduce the friction, without operating in the direct slipstream of the aftmost Pod drives. The reduced friction between the ice and the hull means reduced power to move the vessel. The water wash from the foremost Pod drives, which is directed to the sides of the broken channel, will break the ice on the sides and thus assist to widen the channel. This way of operation can also be used to clean a channel from brash ice, as the forward Pod drives can push the broken ice outwards and below the remaining ice field.

Example 4

Figure 8:
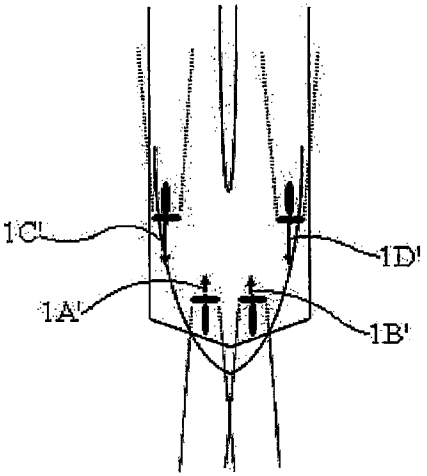
FIG. 8 shows schematically, an alternative way for how the propulsors can be oriented when operating astern whilst also breaking the ice by directing the propeller water wash against the ice astern of the vessel.
Figure 9:
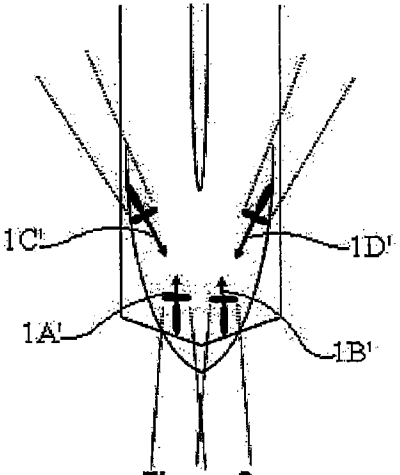
FIG. 9 shows schematically, a combination of the examples in FIGS. 7 and 8.

In FIG. 8 is shown an alternative way of operating by using the aftmost Pod drives 1A and 1B, with their thrust vectors 1A' and 1B' pointing ahead. This will direct the propeller water wash against the ice astern of the vessel to break the ice. The foremost Pod drives 1C and 1D can then have their thrust vectors 1C' and 1D' pointing in the opposite direction, and with a higher thrust than the aftmost thrusters 1A and 1B, to pull the vessel with the stern first, through the broken ice. The foremost Pod drives can also be directed inwards, see FIG. 9, so as to remove the ice from the hull and to widen the channel, as in example 3.

Example 5

Figure 10:
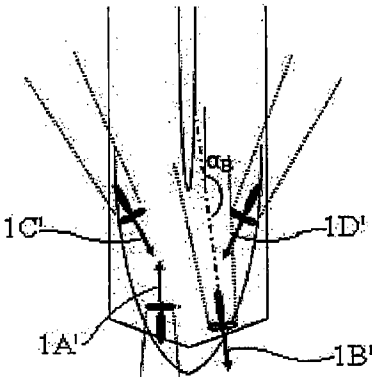
FIG. 10 shows schematically, an alternative way for how the propulsors can be oriented for operating astern whilst also breaking the ice by directing the propeller water wash against the ice astern with one propulsor whilst using the remaining three propulsors for widening and clearing the channel from ice and to propel the vessel astern.
Figure 11:
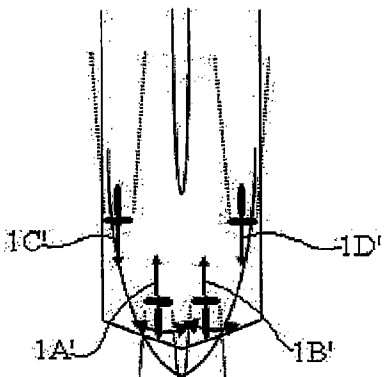
FIG. 11 shows schematically, how the thrusters may be swayed around its vertical axis to achieve a wider path of ice breaking.
Figure 12:
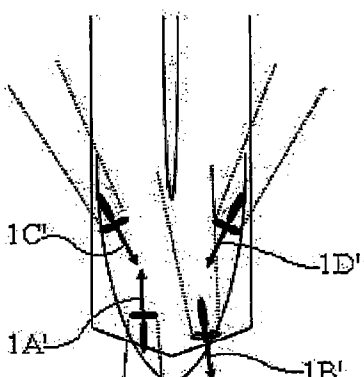
FIG. 12 shows schematically, how the thrusters may be swayed around its vertical axis to achieve a wider path of ice breaking for a configuration as in the example in FIG. 10.
Figure 14:
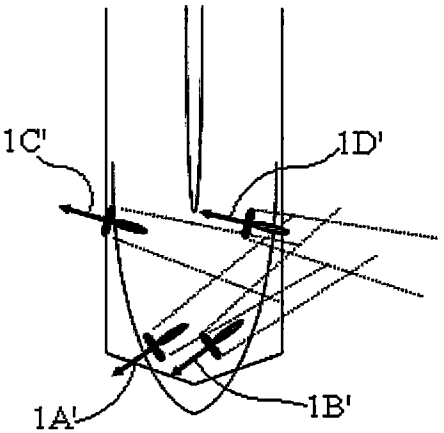
FIG. 14 shows schematically, how the propulsors can be oriented to give large turning thrust without propulsive thrust ahead or astern while avoiding the slipstream to hit propulsor behind another one.
Figure 13:
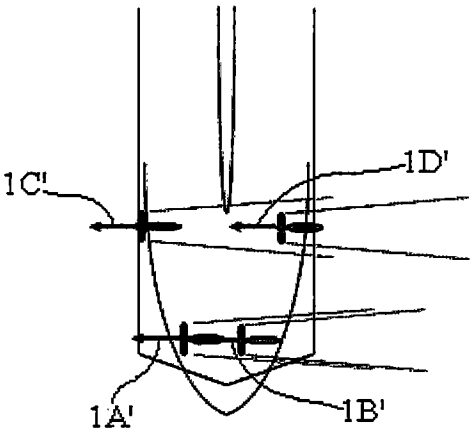
FIG. 13 shows schematically, how the propulsors can be used to create maximum turning thrust without propulsive thrust ahead or astern.

As shown in FIG. 10 alternatively (in relation to FIG. 9) only one of the aftmost Pod drives 1A (or 1B) may have the thrust vector 1A' (or 1B') directed ahead, blowing a jet astern to break the ice whilst the other 1B (or 1A) is directed astern to pull the vessel astern together with the foremost pods 1C and 1D, having either a straight astern direction, as in FIG. 7, or with an inward thrust vector 1B' (or 1A') angle $\alpha_B$ as in FIG. 10.

There are many other ways to combine steering angles and thrust among the 4 propulsors in a quadruple configuration, to achieve different characteristics for the vessel in maneuvering and icebreaking. In all combinations, the thrust must be balanced between the propulsors to achieve the prescribed characteristics when turning, milling or open water operation of the vessel. This can either be done by selecting different sizes or powers of the propulsors, or by selecting different types of propellers (e.g. different pitch settings or diameters) of the propulsors, or by just the setting of the power transmitted to each and every thruster at each and every moment, and of course by combining one or more thereof.

It should also be understood that the angular setting of the propulsors is not to be assumed to be static within a mode of operation, but can be adjusted continuously. In the operation in example shown in FIG. 8 or 10 the steering angle of the aftmost propulsors, $\alpha_A$ and $\alpha_B$ can be swayed from side to side within an angle of +/−60 degrees, this could also preferable be a smaller angle, for example +/−40 degrees or even +/−5 degrees. It could also be more, for example +/−90 degrees. The angular sway could also differ between the port and starboard thruster, so for example it could be +10 and −40 degrees or vice versa or any other steering angle. The steering sway of the propulsors could also be either symmetrical (see FIG. 11) or asymmetrical, between the port and starboard propulsor. The sway of the propulsors could also be totally independently controlled to optimize the ice breaking performance. It could also be so that one or more of the propulsors has a fixed angle for example 0 degrees, or any other steering angle for example +5 degrees or −10 degrees, whilst the other propulsor(s) have a swaying steering motion.

The invention is not limited to the shown embodiment, but several variations are conceivable within the scope of the appended claim. For instance, one or several propulsors may be adjusted in their lateral and/or longitudinal positions such that some or all the lateral pairs are asymmetrical in their lateral and/or longitudinal positions. Moreover the first propulsor 1G may be located away from the longitudinal axis CL.

Further it is foreseen that the azimuthing propulsors may be mechanical thrusters or electrical Pod drives, of pulling or pushing type, with one or two propellers or pump jet rotors, arranged on one or both ends of the propulsor, rotating in one direction or contra-rotating, and with or without nozzles.

Moreover, the azimuthing propulsors may have different propeller diameters and/or design, or have different sizes of motors or strut lengths or a combination of different type of propulsors. For instance the propulsors located at forward distances could be smaller than the aftmost, to facilitate installation or for other operational reasons. They could also be designed differently i.e. the forward propulsors could have propellers designed for optimum efficiency in open water while the aftmost propellers are optimized for interaction with ice.

The invention claimed is:

1. A propulsor arrangement for a marine vessel having a hull with a center line extending between a forward end and an aft end, the propulsor arrangement comprising:

a plurality of azimuthing thrusters having a center of rotation and a longest lateral distance (R) that it protrudes from the center of rotation, wherein the propulsor arrangement includes at least three azimuthing thrusters positioned substantially in V-shape at an end section of the hull at one of the forward end and the aft end, wherein a first pair of the at least four azimuthing thrusters are positioned substantially symmetrical in relation to a center line along a transversal line in relation to the center line a second transversal distance apart, and wherein a second pair of the at least four azimuthing thrusters is positioned closer to the one of the forward end and the aft end and closer to the centerline than the first pair of the at least four azimuthing thrusters and is positioned a longitudinal distance away from said transversal line, wherein the second pair of the at least four azimuthing thrusters is positioned a first transversal distance apart, wherein the first transversal distance is smaller than the second transversal distance.

2. The propulsor arrangement according to claim 1, wherein the second pair of the at least four azimuthing thrusters has propellers configured to act in ice.

3. The propulsor arrangement according to claim 1, wherein the second transversal distance is between 4R and 14R.

4. The propulsor arrangement according to claim 1, wherein the second transversal distance is between 4R and 10R.

5. The propulsor arrangement according to claim 1, wherein the second transversal distance is between 4R and 6R.

6. The propulsor arrangement according to claim 1, wherein the longitudinal distance is between R and 8R.

7. The propulsor arrangement according to claim 1, wherein the longitudinal distance is between 1.5R and 6R.

8. The propulsor arrangement according to claim 1, wherein the longitudinal distance is between 2R and 3R.

9. The propulsor arrangement according to claim 1, wherein a clearance between a tip of a propeller and the hull is larger than 0.3 times a diameter of the propeller.

10. The propulsor arrangement according to claim 1, wherein a clearance between a tip of a propeller and the hull is larger than 0.4 times a diameter of the propeller.

11. The propulsor arrangement according to claim 1, wherein a clearance between a tip of a propeller and the hull is larger than 0.5 times a diameter of the propeller.

12. The propulsor arrangement according to claim 1, wherein the one of the forward and the aft end is wide enough to accommodate at least four azimuthing propulsors, wherein when the vessel moves straight ahead, no one propulsor is hit by slipstream from any propulsor ahead of it.

13. The propulsor arrangement according to claim 1, wherein the one of the forward end and the aft end is wide enough to accommodate at least five azimuthing propulsors, wherein when the vessel moves straight ahead, no one propulsor is hit by a slipstream from any propulsor ahead of it.

14. The propulsor arrangement according to claim 1, wherein the one of the forward end and the aft end is wide enough to accommodate at least seven azimuthing propulsors, wherein when the vessel moves straight ahead, no one propulsor is hit by a slipstream from any propulsor ahead of it.

15. The propulsor arrangement according to claim 1, wherein the vessel is configured to enable movement with the one of the forward end and the aft end first into ice and the second pair of the at least four azimuthing thrusters positioned closer to the one of the forward end and the aft end is arranged to break the ice.

16. The propulsor arrangement according to claim 15, wherein non-ice breaking propulsors are arranged at distances further away from the one end than the second pair of the at least four azimuthing thrusters arranged to break the ice and are arranged to control one or more of: the speed by which the marine vessel approaches the ice, withdrawal of the marine vessel from an ice formation, transportation of broken ice away from the hull, cleaning the channel from brash ice or widening the channel, or steering the marine vessel in any direction.

17. The propulsor arrangement according to claim 1, wherein a clearance between a propeller and the hull is more than 0.3 times a diameter of the propeller.

18. The propulsor arrangement according to claim 1, wherein a clearance between a propeller and the hull is between 0.4 and 1.0 times a diameter of the propeller.

19. The propulsor arrangement according to claim 1, wherein a clearance between a propeller and the hull is between 0.4 and 0.5 times a diameter of the propeller.

20. The propulsor arrangement according to claim 1, wherein the marine vessel is configured to operate astern in ice by arranging propellers of the second pair of the at least four azimuthing thrusters positioned closer to the one of the forward end and the aft end for interaction of the propellers with the ice and at least one other propulsor is arranged to control speed of the marine vessel by applying thrust in an opposite direction.

21. The propulsor arrangement according to claim 1, wherein the marine vessel is configured to operate in ice by arranging propellers of the second pair of the at least four azimuthing thrusters positioned closer to the one of the forward end and the aft end for interaction of the propellers with the ice, and at least one other propulsor is arranged such that a water wash is directed outwards from the marine vessel at a fixed angle or within swaying back and forth in a sector so as to remove broken ice or brash ice away from the hull and under the remaining ice whilst widening a channel with the water wash.

22. The propulsor arrangement according to claim 1, wherein at least one propulsor of the propulsor arrangement is arranged to enable turning in the opposite direction, at a fixed angle or swaying back and forth, to break up an ice formation with propeller water wash.

23. The propulsor according to claim 1, wherein at least one propulsor of the propulsor arrangement is arranged to enable setting out to angles to achieve a different level of turning force, whilst varying propulsive thrust to move the marine vessel ahead or astern or to turn the marine vessel.

24. The propulsor according to claim 1, wherein the second pair of the at least four azimuthing thrusters is positioned at a distance between 1R and 2R from the one of the forward end and the aft end.

25. A propulsor arrangement for a marine vessel having a hull with a center line extending between a forward end and an aft end, the propulsor arrangement comprising:

a plurality of azimuthing thrusters having a center of rotation and a longest lateral distance (R) that it protrudes from the center of rotation, wherein the propulsor arrangement includes at least three azimuthing thrusters positioned substantially in V-shape at an aft section of the hull at the aft end, wherein a pair of the at least three azimuthing thrusters are positioned substantially symmetrical in relation to a center line along a transversal line in relation to the center line a first transferal transversal distance apart, and wherein at least one azimuthing thruster is positioned closer to the aft end and closer to the centerline than the pair of the three azimuthing thrusters and is positioned a longitudinal distance away from said transversal line.

26. A propulsor arrangement for a marine vessel having a hull with a center line extending between a forward end and an aft end, the propulsor arrangement comprising:

a plurality of azimuthing thrusters having a center of rotation and a longest lateral distance (R) that it protrudes from the center of rotation, wherein the propulsor arrangement includes at least four azimuthing thrusters positioned substantially in V-shape at an end section of the hull at one of the forward end and the aft end, wherein a first pair of the at least four azimuthing thrusters are positioned substantially symmetrical in relation to a center line along a transversal line in relation to the center line a second transversal distance apart, wherein a second pair of the at least four azimuthing thrusters are positioned closer to the one of the forward end and the aft end and closer to the centerline than the first pair of the at least four azimuthing thrusters and are positioned a longitudinal distance away from said transversal line, wherein the second pair of the at least four azimuthing thrusters is positioned a first transversal distance apart, wherein the first transversal distance is between 2R and 8R and is smaller than the second transversal distance.

27. A propulsor arrangement for a marine vessel having a hull with a center line extending between a forward end and an aft end, the propulsor arrangement comprising:

a plurality of azimuthing thrusters having a center of rotation and a longest lateral distance (R) that it protrudes from the center of rotation, wherein the propulsor arrangement includes at least four azimuthing thrusters positioned substantially in V-shape at an end section of the hull at one of the forward end and the aft end, wherein a first pair of the at least four azimuthing thrusters are positioned substantially symmetrical in relation to a center line along a transversal line in relation to the center line a second transversal distance apart, wherein a second pair of the at least four azimuthing thrusters are positioned closer to the one of the forward end and the aft end and closer to the centerline than the first pair of the at least four azimuthing thrusters and are positioned a longitudinal distance away from said transversal line, wherein the second pair of the at least four azimuthing thrusters is positioned a first transversal distance apart, wherein the first transversal distance is between 2R and 4R and is smaller than the second transversal distance.

28. A propulsor arrangement for a marine vessel having a hull with a center line extending between a forward end and an aft end, the propulsor arrangement comprising:

a plurality of azimuthing thrusters having a center of rotation and a longest lateral distance (R) that it protrudes from the center of rotation, wherein the propulsor arrangement includes at least four azimuthing thrusters positioned substantially in V-shape at an end section of the hull at one of the forward end and the aft end, wherein a first pair of the at least four azimuthing thrusters are positioned substantially symmetrical in relation to a center line along a transversal line in relation to the center line a second transversal distance apart, wherein a second pair of the at least four azimuthing thrusters are positioned closer to the one of the forward end and the aft end and closer to the centerline than the first pair of the at least four azimuthing thrusters and are positioned a longitudinal distance away from said transversal line, wherein the second pair of the at least four azimuthing thrusters is positioned a first transversal distance apart, wherein the first transversal distance is between 2R and 3R and is smaller than the second transversal distance.

* * * * *